United States Patent [19]

Braunstein et al.

[11] Patent Number: 4,953,848

[45] Date of Patent: Sep. 4, 1990

[54] INDOOR STRUCTURE THAT SIMULATES AN OUTDOOR ENVIRONMENT

[75] Inventors: Michael Braunstein, 2500 Stonehaven Ct. South, Columbus, Ohio 43220; Richard Huggins, Columbus, Ohio

[73] Assignee: Michael Braunstein, Columbus, Ohio

[21] Appl. No.: 409,060

[22] Filed: Sep. 19, 1989

[51] Int. Cl.[5] ..... A63G 1/00

[52] U.S. Cl. ..... 272/8.5; 272/10

[58] Field of Search ..... 272/8 R, 8.5, 9, 10; 362/166, 293, 307, 311, 2; 380/311, 320, 316, 317

[56] References Cited

U.S. PATENT DOCUMENTS 1,218,231 3/1917 Wayrich ..... 272/8.5
2,165,736 7/1939 Tuele ..... 272/8.5
2,336,508 12/1943 Smith et al. ..... 272/8.5 X
4,814,956 3/1989 Kano ..... 272/10 X

*Primary Examiner*—Richard E. Chilcot, Jr.
*Attorney, Agent, or Firm*—Oblon, Spivak, McClelland, Maier & Neustadt

[57] ABSTRACT

The room 10 has a front wall 12 having at least one transparent window 22. The room 10 also has a ceiling 18 that slants from a high end 26 at or adjacent the front wall 12 to a low end 28 removed from the front wall 12. The ceiling 18 has an aperture 30 in it. There is a concave dome 32 on the outside of the ceiling 18 that covers the aperture, and the inside surface of the concave dome 32 is light reflecting. Lights 36 shine appropriate colors on the light reflecting inside surface 34 of the concave dome 32. The lights 36 are concealed from a viewer 24 located on the outside of the front wall 12.

100 Claims, 4 Drawing Sheets

INDOOR STRUCTURE THAT SIMULATES AN OUTDOOR ENVIRONMENT

FIELD OF THE INVENTION

This invention relates to structure (typically an enclosed room) that is located inside or adjacent to a larger structure (such as a house or a restaurant) and that simulates an outdoor environment.

BACKGROUND OF THE INVENTION

Indoor structure that simulates an outdoor environment is used, for example, in dioramas, theaters, and planetaria. Such structures used in dioramas and theaters typically involve ceilings painted either blue to simulate daylight sky or black with painted stars to simulate night sky. Such structures used in planetaria typically include extremely elaborate optical equipment used to project star patterns on a concave surface from a projector located in the same room as the concave surface for the benefit of an audience located in the same room as the concave surface. The former types of structures, however, are not very realistic, and the latter type of structure is extremely expensive.

OBJECTS OF THE INVENTION

It is a principal object of the invention to provide an indoor structure that provides a very realistic illusion of either a daytime or a nighttime sky at a cost that is much less than that of a planetarium.

It is further object of the invention to couple such an illusion with illusions of rain, lightning, fog, and/or other atmospheric effects.

SUMMARY OF THE INVENTION

The inventors have discovered that an extremely realistic illusion of either a daytime or a nighttime sky in an indoor structure can be obtained by providing a room having at least several (and preferably all) of the following characteristics. First, the room has a front wall having at least one transparent window—that is, the illusion is best seen through what appears to be a window to the outside. Second, the room has a ceiling that slants from a high end at or adjacent the front wall to a low end removed from the front wall. Third, the ceiling has an aperture in it. Fourth, there is a concave dome on the outside of the ceiling covering the aperture, and the inside surface of the concave dome is light reflecting. Fifth, a means is provided for shining light of appropriate colors on the light reflecting inside surface of the concave dome. Sixth, the source of the light is concealed from a viewer located on the outside of the front wall.

DETAILED DESCRIPTION OF THE PRESENTLY PREFERRED EMBODIMENT

Figure 1:
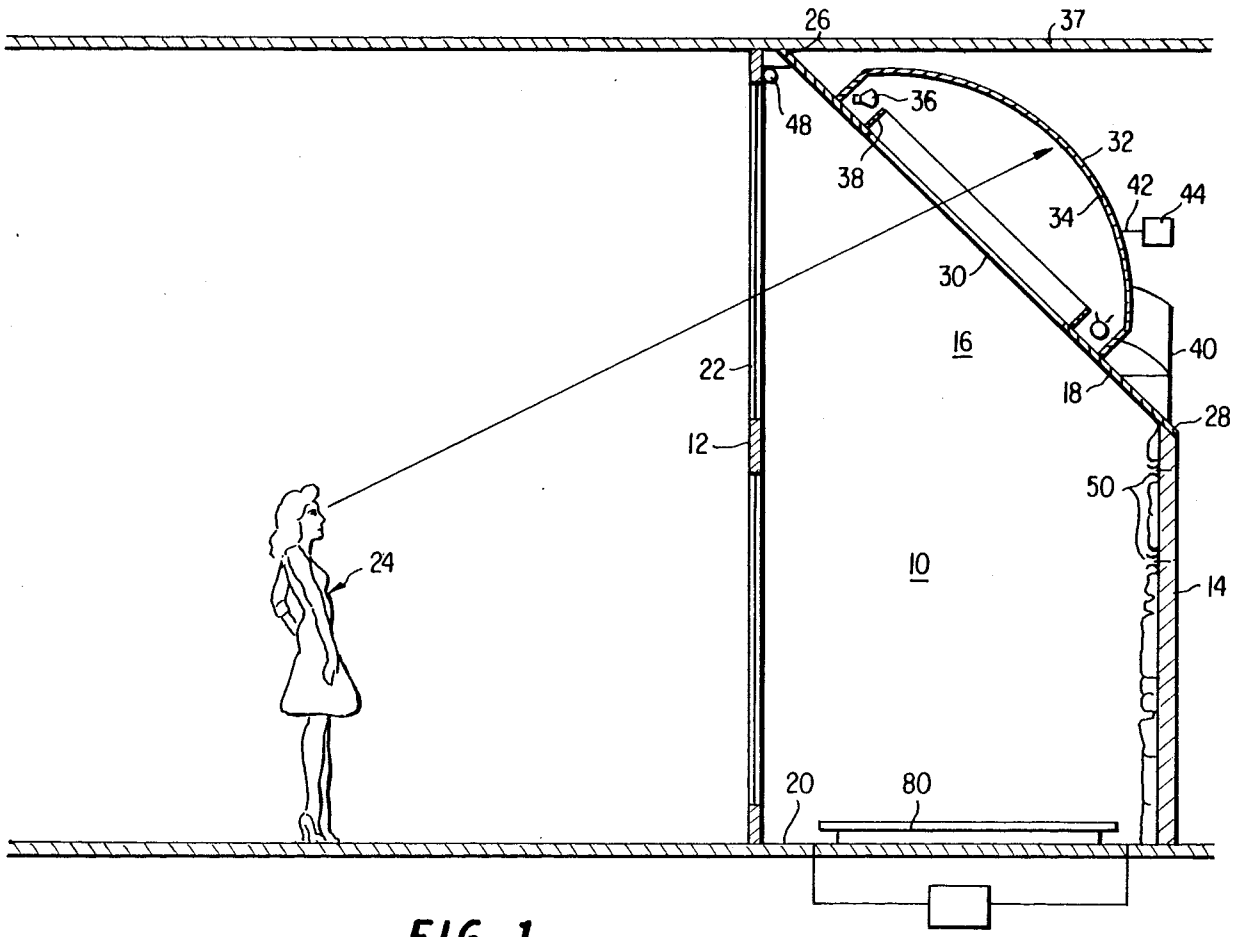
FIG. 1 is a side view of a room according to the invention.
Figure 2:
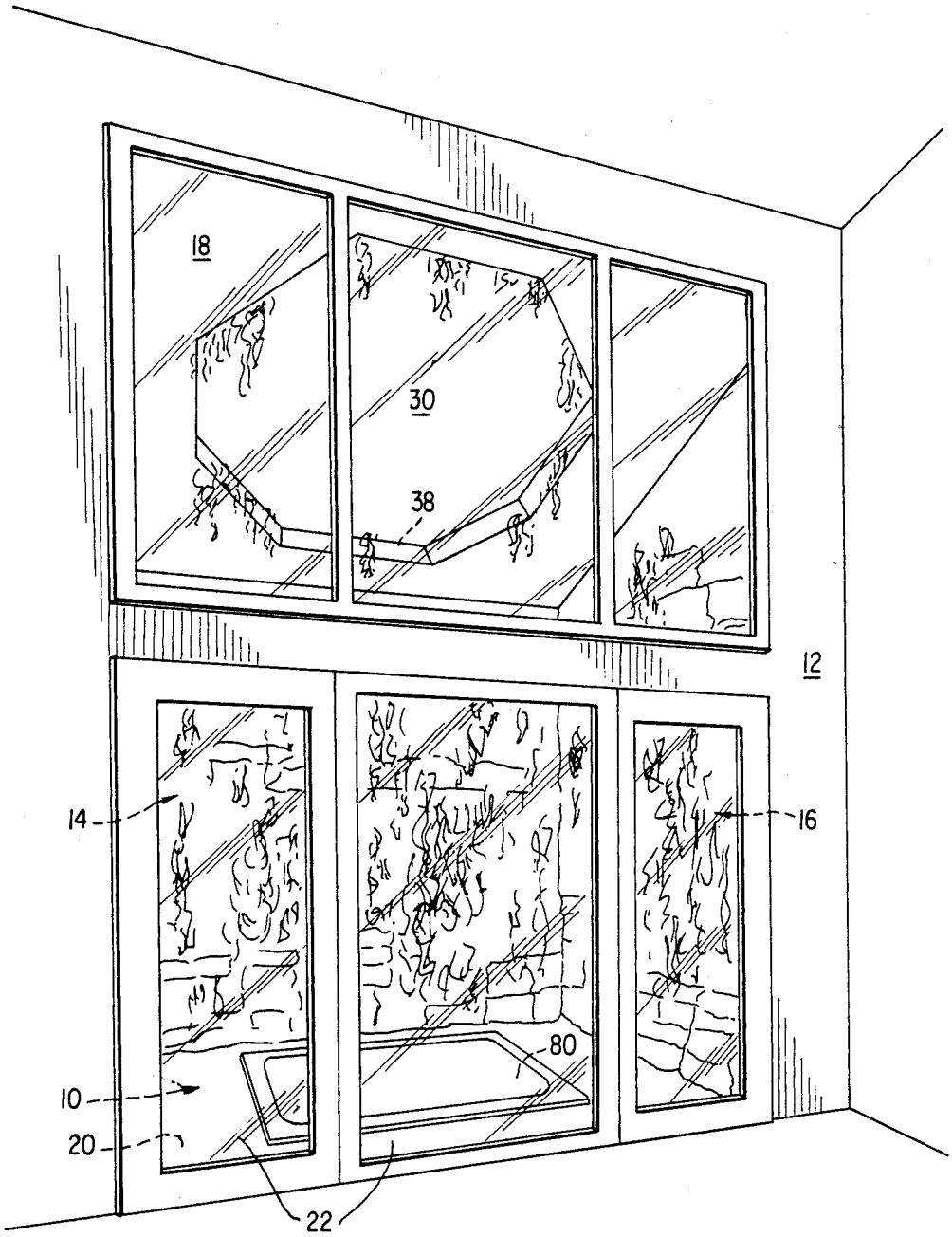
FIG. 2 is a perspective view into a room according to the invention.

FIGS. 1 and 2 show a room 10 in which an outdoor environment can be simulated. The room 10 is defined by a front wall 12, a back wall 14, two side walls 16, a ceiling 18, and a floor 20. (It will, of course, be appreciated that the various surfaces need not be planar, as illustrated, but can be curved or irregular in shape.) The front wall 12 has at least one (preferably several) transparent windows 22 therein so that an observer 24 located outside the room 10 can see into the room 10.

The ceiling 18 slants from a high end 26 at or adjacent the inside of the front wall 12 to a low end 28 removed from the front wall 12. The angle of the slope of the ceiling 18 is fairly important. It is preferably between 10° and 50° to the horizontal, and it is most preferably at least approximately 15° to the horizontal.

An aperture 30 is located in the ceiling 18 in position for the observer 24 to see through the aperture 30, and a concave dome 32 (which is preferably, but not necessarily, circular in cross section) is located on the outside of the ceiling 18 over the aperture 30. (Alternatively, structures having other shapes—such as a planar surface spaced above the aperture 30—can be used. However, the illusion is best with a concave dome.) The concave dome 32 has a light reflecting inside surface 34, and a plurality of lights 36 are mounted on the outside of the ceiling 18 in position to shine light on the light reflecting inside surface 34 of the concave dome 32. Different colored lights 36 can be used to simulate day and night, or colored filters can be interposed between the lights 36 and the light reflecting inside surface 34 of the concave dome 32 under the control of a user at a control board (not shown) or an appropriately programmed computer in a manner well known to, for instance, theatrical set designers. A roof structure 37 preferably covers and conceals the concave dome 32 from observers *not* located in front of the transparent window 22.

Of great importance to the verisimilitude of the illusion is that the lights 36 are concealed from the observer 24. To this end, a collar 38 is mounted on the outside of the ceiling 18 around the aperture 30, and the lights 36 are concealed from view behind the collar 38.

Although not essential, it is desirable that the inside surface of the ceiling 18 be planar, that the light reflecting inside surface 34 be light in color, that the concave dome 32 be part-spherical, and that the side wall 16 and the back wall 14 be covered with simulated rock and/or other materials to simulate the outdoors. Additionally, it is highly desirable that the periphery of the aperture 30 and the cross section of the collar 38 be polygonal, since the contrast of the polygonal shapes of the aperture 30 and the collar 38 with the curvature of the light reflecting inside surface 34 of the concave dome 32 heightens the verisimilitude of the illusion.

For ease in servicing the lights 36 and the plumbing (described below) used to provide an illusion of rain and fog, a catwalk 40 is preferably provided on the outside of the ceiling 18 around the outside of the concave dome 32.

The structure described up to this point provides an excellent simulation of the daytime sky. In order to provide a simulation of the nighttime sky, however, additional structure is needed. That structure can range from very simple to the moderately complex.

The simplest way to provide an illusion of the nighttime sky is to paint stars on the light reflecting inside surface 34 of the concave dome 32 using a paint that absorbs energy from light shone on it at one wavelength (not in the visible spectrum) and that gives off energy as light at another wavelength (in the visible spectrum). Such paint and that technique for simulating stars are well known to theatrical light designers, and that technique works fairly well. However, it suffers from the drawbacks (1) that the stars do not twinkle and (2) that the stars do not move —that is, that only a single nighttime sky can be simulated.

Another, more complex way to provide an illusion of the nighttime sky is to provide a plurality of fiber optic light pipes 42 connected to individual light sources (not shown) in a control box 44 or in a number of control boxes 44. Such star simulators, which are likewise commercially available, are definitely more realistic than the first technique described, since the stars can be made to twinkle and since different constellations can be simulated by activating different light pipes 42. However, such star simulators still suffer from the disadvantage that the stars cannot be made to move relative to the light reflecting inside surface 34 of the concave dome 32.

The most complex, most realistic, and (unfortunately) most expensive way to provide an illusion of the nighttime sky is to provide a simplified planetarium-type projector 46 (or a number of such projectors 46) mixed in with the lights 36. Such a projector, which is likewise commercially available, can be used to project, not only twinkling, movable stars, but also heavenly bodies such as the moon (or multiple moons if it is desired to simulate a non-earth environment), the sun, comets, etc., scudding clouds, and lightning. (Alternatively, lightning can be simulated using strobe lights interspersed among the lights 36 and theatrical "gobos," or lightning templates, in front of the strobe lights.)

An important additional attribute of the room according to the invention is its ability to simulate rain falling into the room 10. That illusion can be accomplished by two means. The first means is a dribble pipe 48 mounted adjacent the inside surface of the front wall 12 above the uppermost edge of the uppermost transparent window 22. The dribble pipe 48 provides a curtain of rain drops visible through the transparent window 22. To provide a really good illusion of rain, however, it is desirable to have droplets falling throughout the volume of the room 10, particularly if there are leaves, surfaces, etc. inside the room 10 which would obviously be visibly wet in a real rainstorm. To accomplish this, a plurality of nozzles 50 are concealed in the back wall 14 and in the side walls 16. (Such nozzles are also commercially available and are known to theatrical set designers.)

Figure 3:
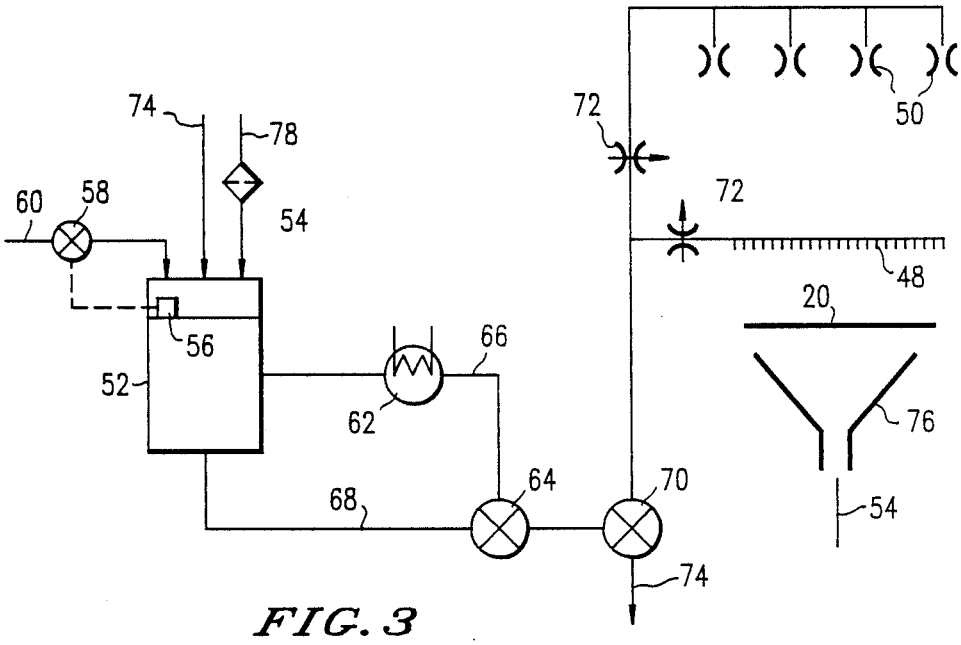
FIG. 3 is a diagram of a system for providing a rain effect in a room according to the invention.

Exemplary plumbing for the rain illusion is shown in FIG. 3. It comprises a holding tank 52 that receives water from a recirculation pipe 54, from a make up supply pipe 60, and from a conduit 74. The level of the water in the holding tank 52 is maintained constant by a level sensing mechanism 56 that controls a valve 58 in the make up supply pipe 60.

Cold water from the holding tank 52 is piped through a hot water heater 62 to a mixing valve 64 through a conduit 66 and directly to the mixing valve 64 through a conduit 68. The mixing valve 64 is under the control of the operator, so the temperature of the rain can be varied as desired.

From the mixing valve 64, the water is pumped (the pump or pumps are not illustrated, but it or they can be included in the system where desired) through a system isolation valve 70 and two independent variable pressure-control valves 72 to the nozzles 50 and the dribble pipe 4, respectively. (The variable pressure control nozzles 72 are under the control of the operator, and they can be used to vary the portion of the rain illusion coming from each source.)

The system isolation valve 70 is connected to the conduit 74, which in turn is connected to the holding tank 52, and the system isolation valve 70 is arranged to allow the water downstream of that valve to flow back into the holding tank 52 when the rain illusion is turned off. (Typically the plumbing, including the holding tank 52, is located in a lower level floor, and the water flows back into the holding tank 52 under the force of gravity when the pump or pumps driving the rain illusion is or are turned off. However, the pump or pumps can obviously be made reversible if the holding tank 52 is above the dribble pipe 48 and the nozzles 50.)

Finally, water from the dribble pipe 48 and the nozzles 50 is collected in a catchment system 76 beneath the floor 20, and the water from the catchment system 76 is lead back to the holding tank 52 through the recirculation pipe 54 via a filter 78.

Of course, it will be appreciated that the conduit 74 can feed into the recirculation pipe 54 rather than feeding separately into the holding tank 52, that the conduits 66 and 68 can feed from a single outlet in the holding tank 52, etc., etc. Similarly, it may be desired not to recirculate the water at all (particularly if users are given access to the room 10). In that event, the pipe 54 can lead to a storm sewer or to an irrigation system rather than to the holding tank 52, and the holding tank 52 can be eliminated in favor of use of fresh water at all times.

A hot water tub 80 or an indoor pool (not illustrated) can be located in the floor 20. However, its plumbing is preferably separate from the plumbing described above.

A further important attribute of the room according to the invention is its ability to simulate fog in the room 10. It is particularly noteworthy that the fog often gives a cloud chamber effect (i.e., an effect of clouds suspended in or just beneath the concave dome 32) due to the hot air present in the concave dome 32 because of heat from the lights 36 and the relatively cold air in the room 10 beneath the ceiling 18. The fog illusion can be accomplished by the use of commercially available fog generators concealed in the walls 14, 16 of the room 10 and/or in the floor 20 of the room 10.

Figure 4:
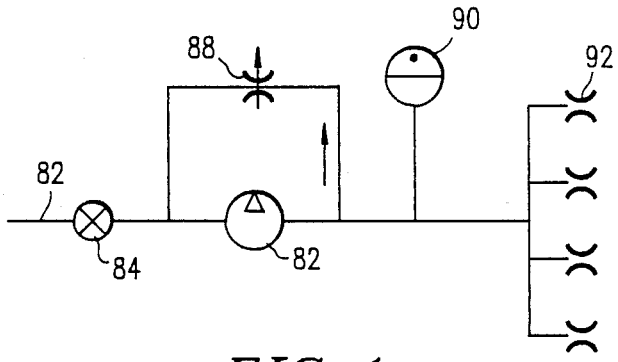
FIG. 4 is a diagram of a system for providing a fog or low-hanging cloud effect in a room according to the invention.

Exemplary plumbing for the fog illusion is shown in FIG. 4. It comprises an inlet conduit 82 leading through a system isolation valve 84 (to permit the system to be isolated for maintenance), through a pump 86 (bracketed by a feedback loop containing a variable flow valve 88 to permit the intensity of the fog to be varied), past a hydraulic accumulator 90 (to damp out pulses from the pump 86), and to a plurality of vaporization nozzles 92.

Condensation of the fog is fed back to the holding tank 52 through the catchment system 76. However, a more serious problem than condensation of the fog on the floor 20 is condensation of the fog or rain on the transparent windows 22—since that, of course, obscures the view into the room 10. To solve that problem, the transparent windows 22 are preferably heatable by transparent electrically conductive films to dry the water (whether from the rain or from fog condensation) on their inside surfaces. Alternatively, the same result could be accomplished using blown air, electrically conductive filaments embedded in the transparent window 22, etc., etc.

Finally, the illusion is considerably enhanced by the provision of recorded sounds appropriate to the illusion being generated. Of course, recordings of rain, thunder, bird songs, wind, and the like are readily available and can be integrated into the overall display under the control of the operator—which can be human or an appropriately programmed control system.

Caveat

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An indoor structure that simulates an outdoor environment, said structure comprising:
   (a) a front wall having at least one transparent window therein, said front wall having a first side and a second side;
   (b) a ceiling which slants from a high end at or adjacent said second side of said front wall to a low end removed from said front wall, said ceiling having an inside surface facing said wall and an outside surface facing away from said wall;
   (c) an aperture in said ceiling, said aperture having a periphery;
   (d) a concave dome located on the outside of said ceiling over said aperture, said concave dome having a light reflecting inside surface facing said ceiling and an outside surface facing away from said ceiling;
   (e) first means for shining light on said light reflecting inside surface of said concave dome; and
   (f) second means for concealing said first means from a viewer located on said first side of said front wall.

2. A structure as recited in Claim 1 wherein said inside surface of said ceiling is planar.

3. A structure as recited in Claim 1 wherein said light reflecting inside surface of said concave dome is light in color.

4. A structure as recited in Claim 1 wherein said light reflecting inside surface of said concave dome is part-spherical.

5. A structure as recited in Claim 1 wherein said first means comprises a plurality of lights mounted on said outside surface of said ceiling around said periphery of said aperture.

6. A structure as recited in Claim 1 wherein said second means comprises a collar projecting from said outside surface of said ceiling around said periphery of said aperture.

7. A structure as recited in Claim 1 wherein said aperture is polygonal in shape.

8. A structure as recited in Claim 1 and further comprising a catwalk mounted on said outside surface of said ceiling around said concave dome, said catwalk being usable to service said first means.

9. A structure as recited in Claim 1 and further comprising third means for simulating rain inside said structure.

10. A structure as recited in Claim 1 and further comprising a dribble pipe mounted adjacent said second side of said front wall above said at least one transparent window.

11. A structure as recited in claim 1 and further comprising at least one additional wall.

12. A structure as recited in claim 11 and further comprising a plurality of rain-simulating nozzles concealed in said at least one additional wall and oriented so as to spray drops of simulated rain into said structure.

13. A structure as recited in claim 11 wherein said at least one additional wall is surfaced with simulated rocks.

14. A structure as recited in claim 1 and further comprising a hot tub located beneath said aperture.

15. A structure as recited in claim 1 and further comprising fourth means for generating fog in said structure.

16. A structure as recited in claim 1 and further comprising fifth means for simulating stars on said light reflecting inside surface of said concave dome.

17. A structure as recited in claim 1 and further comprising a plurality of stars painted on said light reflecting inside surface of said concave dome with a paint that absorbs energy from light shone on it at one wavelength and that gives off energy as light at another wavelength.

18. A structure as recited in claim 1 and further comprising a plurality of fiber optic light pipes that project through said light reflecting inside surface of said concave dome from the outside surface of said concave dome such that light piped therethrough gives the appearance of stars on said light reflecting inside surface of said concave dome.

19. A structure as recited in claim 1 and further comprising sixth means for projecting images of clouds on said light reflecting inside surface of said concave dome.

20. A structure as recited in claim 1 and further comprising seventh means for projecting images of lightning on said light reflecting inside surface of said concave dome.

21. A structure as recited in claim 1 and further comprising eighth means for broadcasting sounds audible to a viewer located on said first side of said front wall.

22. A structure as recited in claim 1 wherein said ceiling slants at an angle of between 10° and 50° to the horizontal.

23. A structure as recited in claim 22 wherein said ceiling slants at an angle of at least approximately 15° to the horizontal.

24. A structure as recited in claim 1 and further comprising ninth means for heating said at least one transparent window to dry water or condensation located on the inside surface thereof.

25. A structure as recited in claim 1 and further comprising tenth means for projecting images of heavenly bodies on said light reflecting inside surface of said concave dome.

26. A structure as recited in claim 1 and further comprising a roof structure covering and concealing said concave dome.

27. An indoor structure that simulates an outdoor environment, said structure comprising:
   (a) a front wall having at least one transparent window therein, said front wall having a first side and a second side;
   (b) a ceiling having an inside surface and an outside surface;
   (c) an aperture in said ceiling, said aperture having a periphery;

(d) a concave dome located on the outside of said ceiling over said aperture, said concave dome having a light reflecting inside surface facing said ceiling and an outside surface facing away from said ceiling;

(e) first means for shining light on said light reflecting inside surface of said concave dome; and (f) second means for concealing said first means from a viewer located on said first side of said front wall.

28. A structure as recited in claim 27 wherein said inside surface of said ceiling is planar.

29. A structure as recited in claim 27 wherein said light reflecting inside surface of said concave dome is light in color.

30. A structure as recited in claim 27 wherein said light reflecting inside surface of said concave dome is part-spherical.

31. A structure as recited in claim 27 wherein said first means comprises a plurality of lights mounted on said outside surface of said ceiling around said periphery of said aperture.

32. A structure as recited in claim 27 wherein said second means comprises a collar projecting from said outside surface of said ceiling around said periphery of said aperture.

33. A structure as recited in claim 27 wherein said aperture is polygonal in shape.

34. A structure as recited in claim 27 and further comprising a catwalk mounted on said outside surface of said ceiling around said concave dome, said catwalk being usable to service said first means.

35. A structure as recited in claim 27 and further comprising third means for simulating rain inside said structure.

36. A structure as recited in claim 27 and further comprising a dribble pipe mounted adjacent said second side of said front wall above said at least one transparent window.

37. A structure as recited in claim 27 and further comprising at least one additional wall.

38. A structure as recited in claim 37 and further comprising a plurality of rain-simulating nozzles concealed in said at least one additional wall and oriented so as to spray drops of simulated rain into said structure.

39. A structure as recited in claim 37 wherein said at least one additional wall is surfaced with simulated rocks.

40. A structure as recited in claim 27 and further comprising a hot tub located beneath said aperture.

41. A structure as recited in claim 27 and further comprising fourth means for generating fog in said structure.

42. A structure as recited in claim 27 and further comprising fifth means for simulating stars on said light reflecting inside surface of said concave dome.

43. A structure as recited in claim 27 and further comprising a plurality of stars painted on said light reflecting inside surface of said concave dome with a paint that absorbs energy from light shone on it at one wavelength and that gives off energy as light at another wavelength.

44. A structure as recited in claim 27 and further comprising a plurality of fiber optic light pipes that project through said light reflecting inside surface of said concave dome from the outside surface of said concave dome such that light piped therethrough gives the appearance of stars on said light reflecting inside surface of said concave dome.

45. A structure as recited in claim 27 and further comprising sixth means for projecting images of clouds on said light reflecting inside surface of said concave dome.

46. A structure as recited in claim 27 and further comprising seventh means for projecting images of lightning on said light reflecting inside surface of said concave dome.

47. A structure as recited in claim 27 and further comprising eighth means for broadcasting sounds audible to a viewer located on said first side of said front wall.

48. A structure as recited in claim 27 and further comprising ninth means for heating said at least one transparent window to dry water or condensation located on the inside surface thereof.

49. A structure as recited in claim 27 and further comprising tenth means for projecting images of heavenly bodies on said light reflecting inside surface of said concave dome.

50. A structure as recited in claim 27 and further comprising a roof structure covering and concealing said concave dome.

51. An indoor structure that simulates an outdoor environment, said structure comprising:

(a) a ceiling which slants from a high end to a low end, said ceiling having an inside surface and an outside surface;

(b) an aperture in said ceiling, said aperture having a periphery;

(c) a concave dome located on the outside of said ceiling over said aperture, said concave dome having a light reflecting inside surface facing said ceiling and an outside surface facing away from said ceiling;

(d) first means for shining light on said light reflecting inside surface of said concave dome; and (e) second means for concealing said first means from a viewer located on said first side of said front wall.

52. A structure as recited in claim 51 wherein said inside surface of said ceiling is planar.

53. A structure as recited in claim 51 wherein said light reflecting inside surface of said concave dome is light in color.

54. A structure as recited in claim 51 wherein said light reflecting inside surface of said concave dome is part-spherical.

55. A structure as recited in claim 51 wherein said first means comprises a plurality of lights mounted on said outside surface of said ceiling around said periphery of said aperture.

56. A structure as recited in claim 51 wherein said second means comprises a collar projecting from said outside surface of said ceiling around said periphery of said aperture.

57. A structure as recited in claim 51 wherein said aperture is polygonal in shape.

58. A structure as recited in claim 51 and further comprising a catwalk mounted on said outside surface of said ceiling around said concave dome, said catwalk being usable to service said first means.

59. A structure as recited in claim 51 and further comprising third means for simulating rain inside said structure.

60. A structure as recited in claim 51 and further comprising a dribble pipe mounted adjacent said ceiling.

61. A structure as recited in claim 51 and further comprising at least one additional wall.

62. A structure as recited in claim 61 and further comprising a plurality of rain-simulating nozzles concealed in said at least one additional wall and oriented so as to spray drops of simulated rain into said structure.

63. A structure as recited in claim 61 wherein said at least one additional wall is surfaced with simulated rocks.

64. A structure as recited in claim 51 and further comprising a hot tub located beneath said aperture.

65. A structure as recited in claim 51 and further comprising fourth means for generating fog in said structure.

66. A structure as recited in claim 51 and further comprising fifth means for simulating stars on said light reflecting inside surface of said concave dome.

67. A structure as recited in claim 51 and further comprising a plurality of stars painted on said light reflecting inside surface of said concave dome with a paint that absorbs energy from light shone on it at one wavelength and that gives off energy as light at another wavelength.

68. A structure as recited in claim 51 and further comprising a plurality of fiber optic light pipes that project through said light reflecting inside surface of said concave dome from the outside surface of said concave dome such that light piped therethrough gives the appearance of stars on said light reflecting inside surface of said concave dome.

69. A structure as recited in claim 51 and further comprising sixth means for projecting images of clouds on said light reflecting inside surface of said concave dome.

70. A structure as recited in claim 51 and further comprising seventh means for projecting images of lightning on said light reflecting inside surface of said concave dome.

71. A structure as recited in claim 51 and further comprising eighth means for broadcasting sounds audible to a viewer located on said first side of said front wall.

72. A structure as recited in claim 51 wherein said ceiling slants at an angle of between 10° and 50° to the horizontal.

73. A structure as recited in claim 72 wherein said ceiling slants at an angle of at least approximately 15° to the horizontal.

74. A structure as recited in claim 51 and further comprising tenth means for projecting images of heavenly bodies on said light reflecting inside surface of said concave dome.

75. A structure as recited in claim 51 and further comprising a roof structure covering and concealing said concave dome.

76. An indoor structure that simulates an outdoor environment, said structure comprising:

(a) a front wall having at least one transparent window therein, said front wall having a first side and a second side;

(b) a ceiling which slants from a high end at or adjacent said second side of said front wall to a low end removed from said front wall, said ceiling having an inside surface facing said wall and an outside surface facing away from said wall;

(c) an aperture in said ceiling, said aperture having a periphery;

(d) a structure located on the outside of said ceiling over said aperture, said structure having a light reflecting inside surface facing said ceiling and an outside surface facing away from said ceiling;

(e) first means for shining light on said light reflecting inside surface of said structure; and (f) second means for concealing said first means from a viewer located on said first side of said front wall.

77. An indoor structure as recited in claim 76 wherein said inside surface of said ceiling is planar.

78. An indoor structure as recited in claim 76 wherein said light reflecting inside surface of said structure is light in color.

79. An indoor structure as recited in claim 76 wherein said first means comprises a plurality of lights mounted on said outside surface of said ceiling around said periphery of said aperture.

80. An indoor structure as recited in claim 76 wherein said second means comprises a collar projecting from said outside surface of said ceiling around said periphery of said aperture.

81. An indoor structure as recited in claim 76 wherein said aperture is polygonal in shape.

82. An indoor structure as recited in claim 76 and further comprising a catwalk mounted on said outside surface of said ceiling around said structure, said catwalk being usable to service said first means.

83. An indoor structure as recited in claim 76 and further comprising third means for simulating rain inside said indoor structure.

84. An indoor structure as recited in claim 76 and further comprising a dribble pipe mounted adjacent said second side of said front wall above said at least one transparent window.

85. An indoor structure as recited in claim 76 and further comprising at least one additional wall.

86. An indoor structure as recited in claim 85 and further comprising a plurality of rain-simulating nozzles concealed in said at least one additional wall and oriented so as to spray drops of simulated rain into said indoor structure.

87. An indoor structure as recited in claim 85 wherein said at least one additional wall is surfaced with simulated rocks.

88. An indoor structure as recited in claim 76 and further comprising a hot tub located beneath said aperture.

89. An indoor structure as recited in claim 76 and further comprising fourth means for generating fog in said indoor structure.

90. An indoor structure as recited in claim 76 and further comprising fifth means for simulating stars on said light reflecting inside surface of said structure.

91. An indoor structure as recited in claim 76 and further comprising a plurality of stars painted on said light reflecting inside surface of said structure with a paint that absorbs energy from light shone on it at one wavelength and that gives off energy as light at another wavelength.

92. An indoor structure as recited in claim 76 and further comprising a plurality of fiber optic light pipes that project through said light reflecting inside surface of said structure from the outside surface of said structure such that light piped therethrough gives the appearance of stars on said light reflecting inside surface of said structure.

93. An indoor structure as recited in claim 76 and further comprising sixth means for projecting images of clouds on said light reflecting inside surface of said structure.

94. An indoor structure as recited in claim 76 and further comprising seventh means for projecting images of lightning on said light reflecting inside surface of said structure.

95. An indoor structure as recited in claim 76 and further comprising eighth means for broadcasting sounds audible to a viewer located on said first side of said front wall.

96. An indoor structure as recited in claim 76 wherein said ceiling slants at an angle of between 10° and 50° to the horizontal.

97. An indoor structure as recited in claim 96 wherein said ceiling slants at an angle of at least approximately 15° to the horizontal.

98. An indoor structure as recited in claim 76 and further comprising ninth means for heating said at least one transparent window to dry water or condensation located on the inside surface thereof.

99. An indoor structure as recited in claim 76 and further comprising tenth means for projecting images of heavenly bodies on said light reflecting inside surface of said structure.

100. An indoor structure as recited in claim 76 and further comprising a roof structure covering and concealing said structure.

* * * * *